US005787783A

United States Patent [19]

Evans et al.

[11] Patent Number: 5,787,783

[45] Date of Patent: *Aug. 4, 1998

[54] LEVER OPERATED PUNCH WITH STRENGTHENED FLAP AND PUNCH HEAD ADJUSTMENT ARRANGEMENT

[75] Inventors: Alfred J. Evans, Lake In the Hills; Balaji Kandasamy, Chicago, both of Ill.

[73] Assignee: Acco Brands, Inc., Lincolnshire, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 516,022

[22] Filed: Aug. 17, 1995

[51] Int. Cl.[6] ..... B26D 7/20

[52] U.S. Cl. ..... 83/618; 83/634

[58] Field of Search ..... 83/618, 167, 633, 83/634

[56] References Cited

U.S. PATENT DOCUMENTS

| | | | |
|---|---|---|---|
| 1,728,475 | 9/1929 | Cavill | 83/633 X |
| 1,870,055 | 8/1932 | Kline | 83/633 X |
| 2,244,320 | 6/1941 | Unger | 83/633 X |
| 2,368,790 | 2/1945 | Unger | 83/167 X |
| 2,389,105 | 11/1945 | Kern | 83/167 |
| 2,481,883 | 9/1949 | Semler | 83/633 X |
| 2,494,836 | 1/1950 | Segal | 83/167 |
| 3,176,570 | 4/1965 | Gaya | 83/633 X |
| 3,714,857 | 2/1973 | Stuertz et al. | 83/522.19 X |

*Primary Examiner*—Maurina T. Rachuba

*Attorney, Agent, or Firm*—Pennie & Edmonds LLP

[57] ABSTRACT

A hand-operated punch with adjustable assembly punch units and a slipper to receive punched out discs in which the assembly units are adjustable from the bottom through an opening in the slipper. The punch includes a strengthening flap configuration and the assembly units slide but do not turn during adjustment.

6 Claims, 9 Drawing Sheets

LEVER OPERATED PUNCH WITH STRENGTHENED FLAP AND PUNCH HEAD ADJUSTMENT ARRANGEMENT

BACKGROUND OF THE INVENTION

Punches with slidable slippers are old. Slippered punches with adjustable punch stations are also old but removal of the slipper is required to accomplish adjustment.

SUMMARY OF THE INVENTION

Broadly, the present invention is a slippered adjustable hand-operated punch with adjustment accomplished from the bottom of the punch without slipper removal. The flap handle is configured for added strength.

DESCRIPTION OF THE PREFERRED EMBODIMENT

Figure 1:
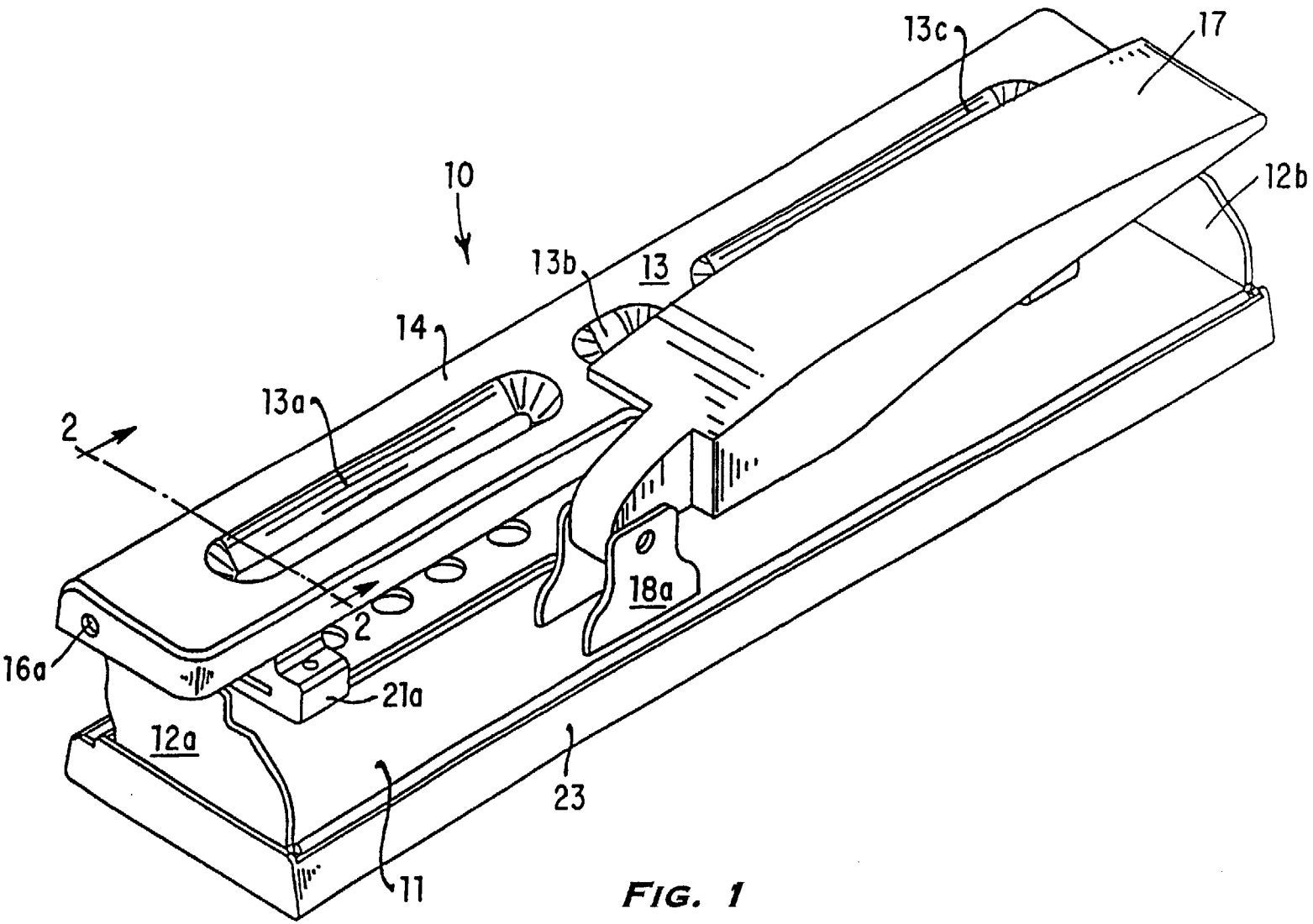
FIG. 1 is a perspective view of the punch of the present invention having a handle and a lever.

In FIGS. 1–4, punch 10 includes base 11, end uprights 12*a*, 12*b*, handle 14 including upper planar surface 13, handle depressions 13*a*, 13*b*, 13*c* mounted for pivoting around pivot pins 16*a*, 16*b* on end uprights 12*a*, 12*b* which define the first and second ends, respectively, of the punch. Lever 17 is pivotally mounted on brackets 18*a*, 18*b*. Also shown are punch assembly heads 21*a*, 21*b*, 21*c* and slipper 23 mounted on base rails 11*a*, 11*b*. Punch assembly heads 21*a*–*c* include punch pins P and curled projections 34*a*–*c* which reside in groove 40 to prevent turning of punch assembly heads 21*a*–*c* as they are translated (see also FIG. 7).

Figure 2:
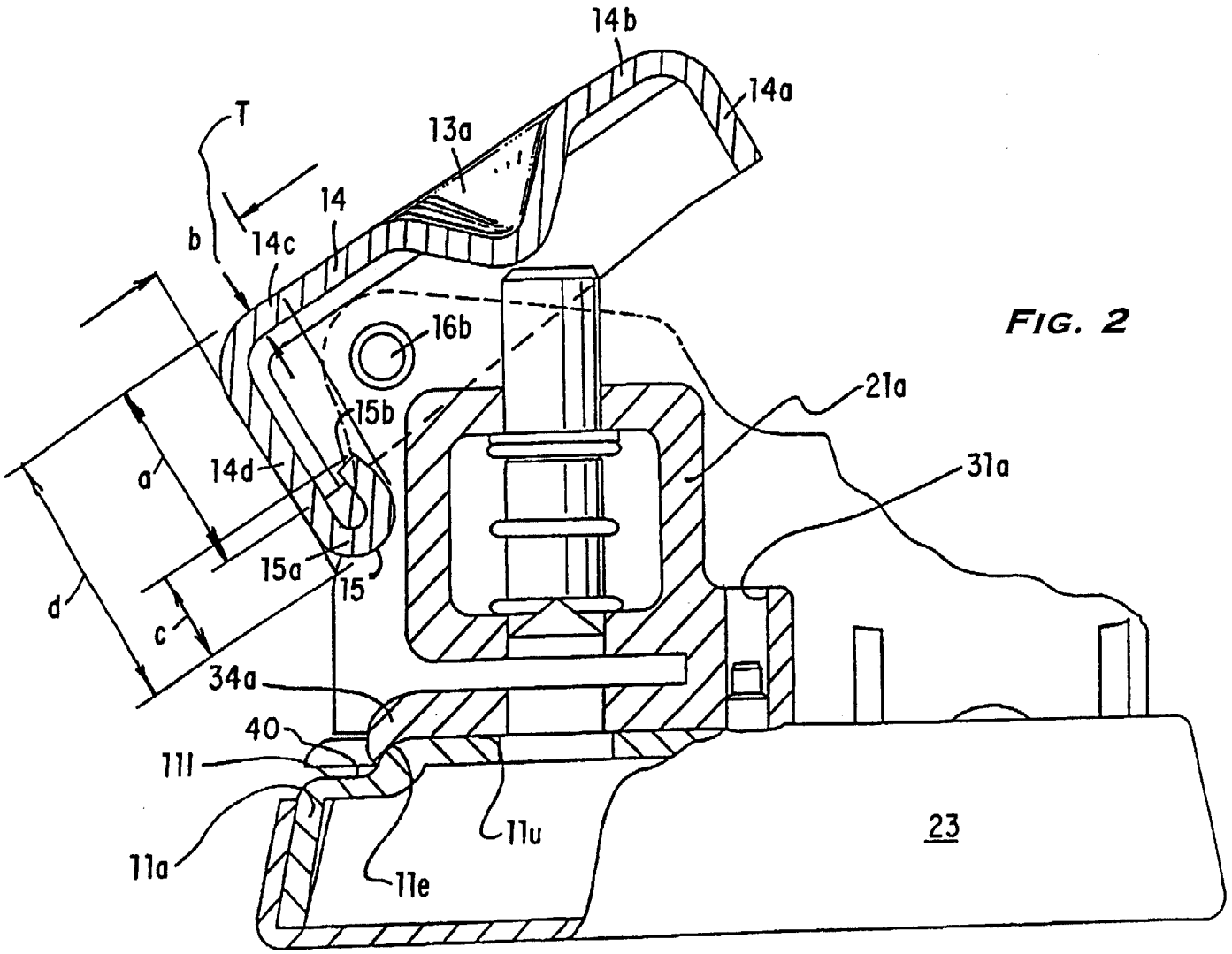
FIG. 2 is a sectional view taken along line 2—2 of FIG. 1 showing the flap handle's reverse curl.
Figure 3:
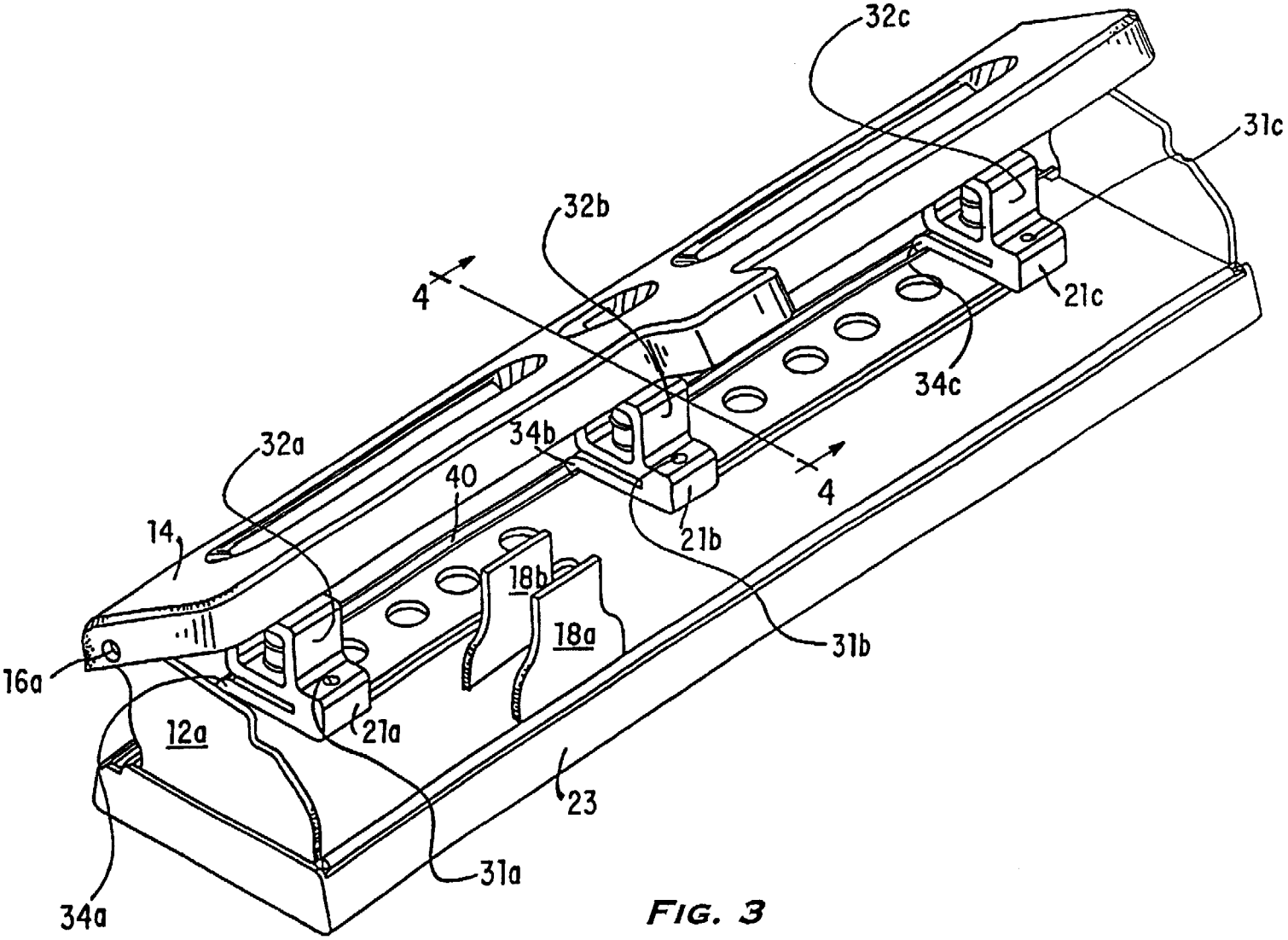
FIG. 3 is a perspective view of the punch with lever removed.

Turning in particular to FIG. 2, handle 14 is formed of a sheet metal and comprises remote flange portion 14*a* substantially perpendicular to upper planar surface 13, (remote from pivot pins 16*a*, 16*b*); remote planar portion 14*b*, handle depression 13*a*, near planar portion 14*c*; near flange portion 14*d* perpendicular to upper planar surface 13 and reverse curl portion 15. Reverse curl portion 15 functions to stiffen and otherwise strengthen handle 14 and includes arc portion 15*a* and upright lip portion 15*b*.

The sheet metal of handle 14 has thickness T. Table 1 below outlines ranges of handle 14 portions in relationship to thickness T.

TABLE 1

| Portion(s) | Dimension | Range |
|---|---|---|
| 1. Near flange portion | a | 6T–8T |
| 2. Curl portion width | b | 2.5T–4T |
| 3. Curl portion depth | c | 2.5T–4T |
| 4. Near flange portion plus depth of curl portion | d | 9T–11T |

Figure 4:
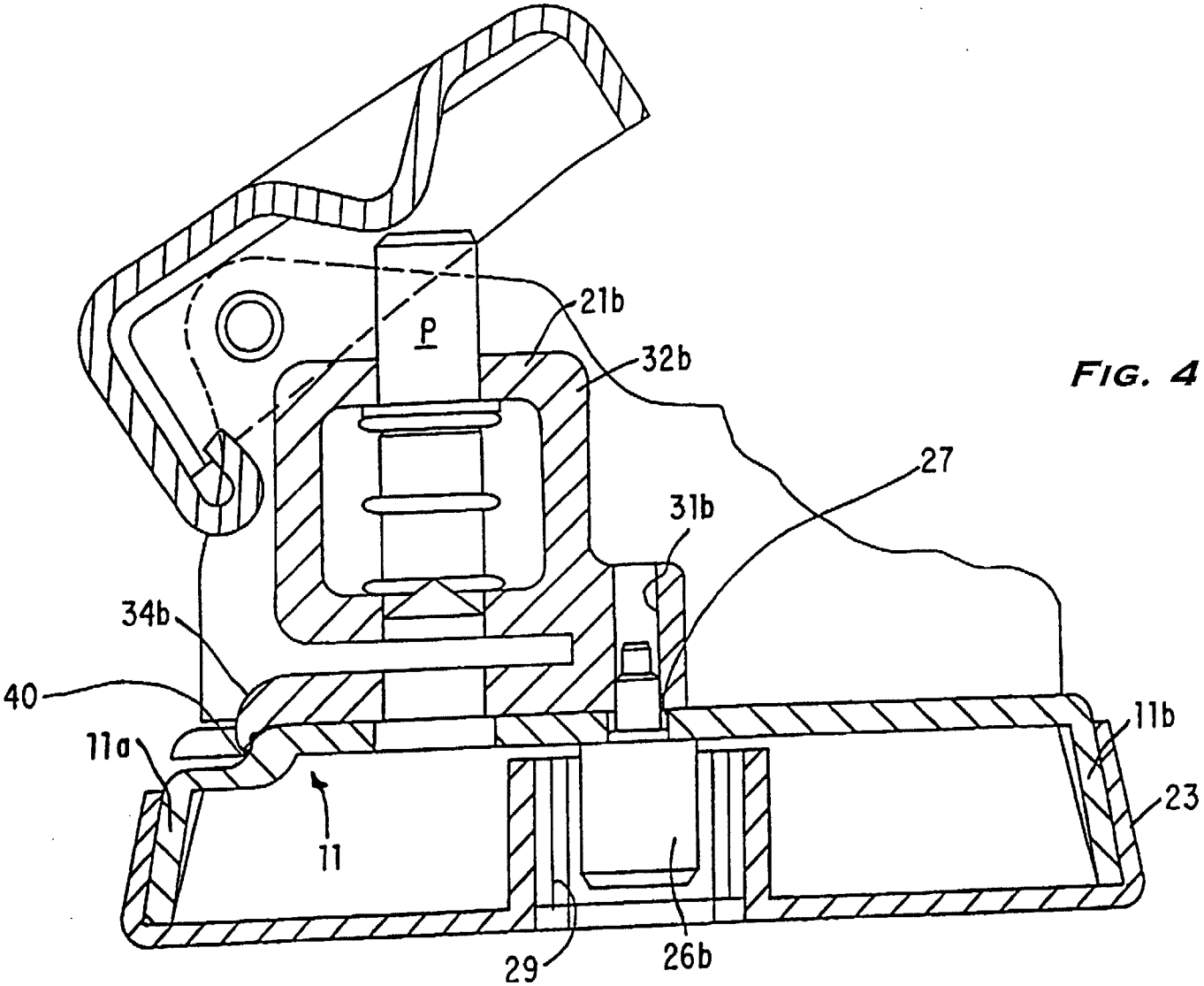
FIG. 4 is a sectional view along line 4—4 of FIG. 3.
Figure 5:
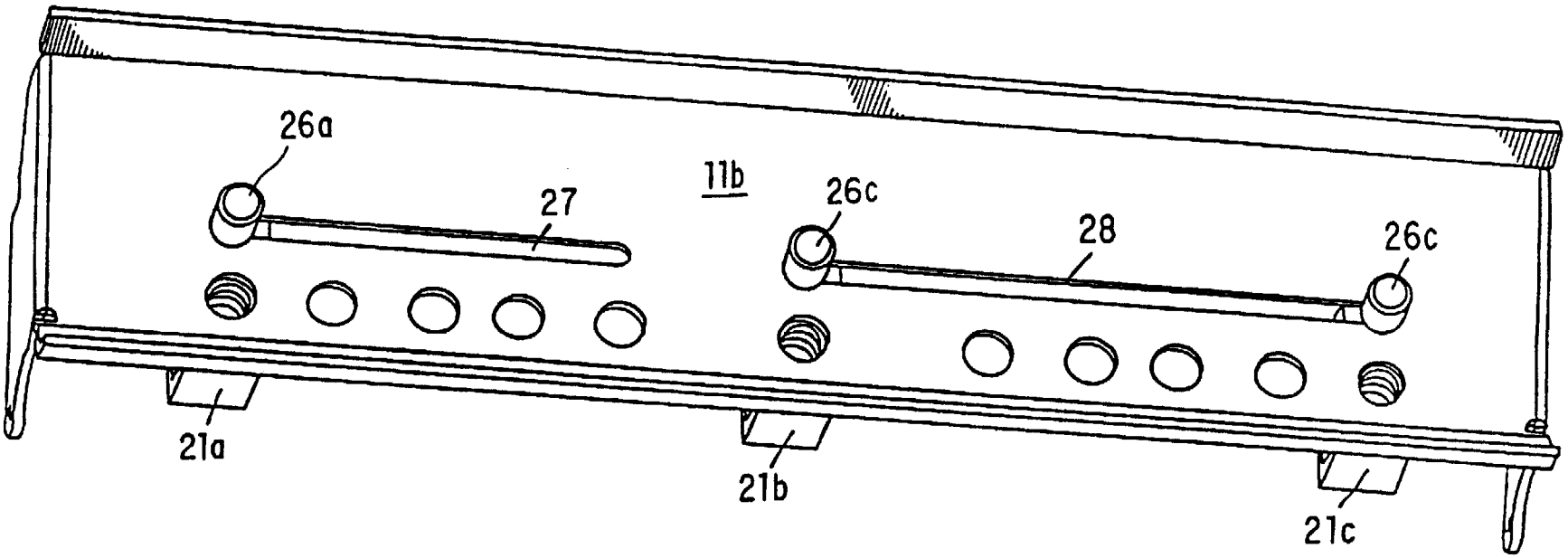
FIG. 5 is a bottom perspective view of the punch with slipper removed.
Figure 6:
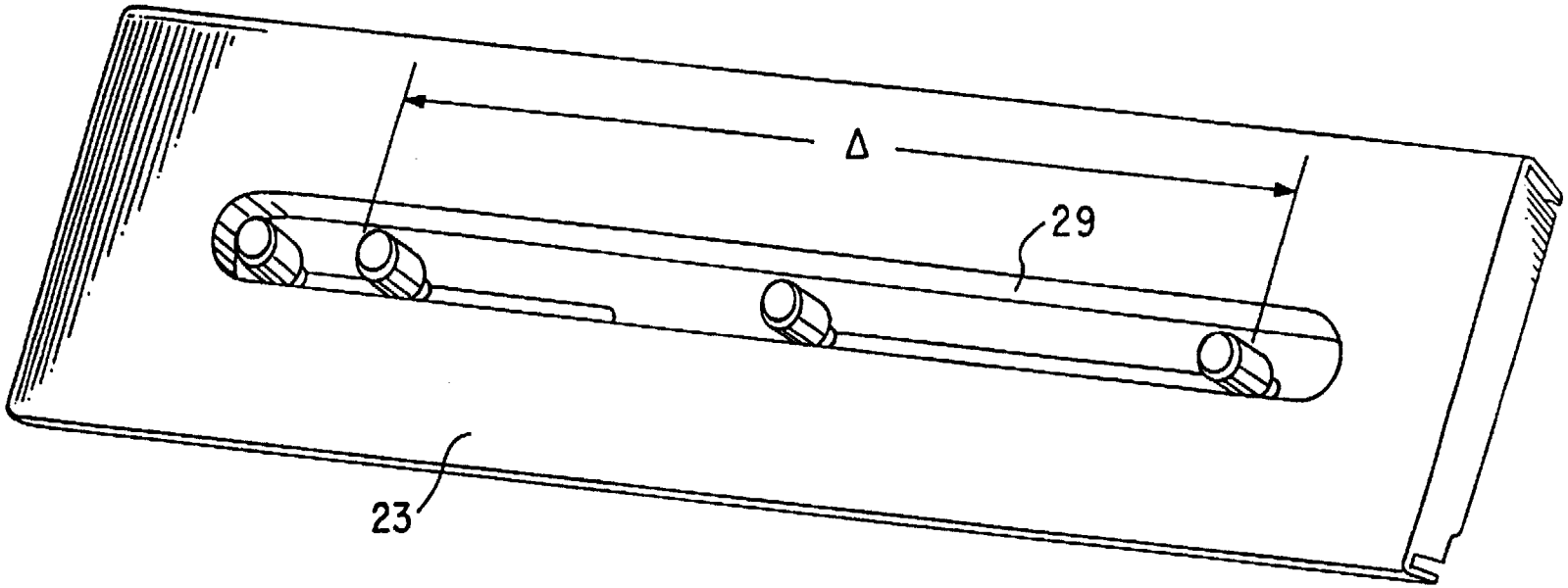
FIG. 6 is a partial perspective bottom view of the punch with the slipper installed.

Turning to FIGS. 4–8, it is seen that punch assembly heads 21*a*, 21*b* and 21*c* are adjustable using retaining screws 26*a*, 26*b* and 26*c* which travel in adjustment slots 27, 28 (FIG. 5) while the curled projections 34*a*–*c* travel in the longitudinal groove 40. Groove 40 is a longitudinal area below upper frame surface 11*u* and above a lower frame surface 111. Curled projections 34*a*–*c* extend beyond and below upper frame surface 11*u* which permits the curled projections 34*a*–*c* to move back and forth in groove 40 during adjustment of the punch assembly heads and while preventing rotation of the heads 21*a*–*c* during their loosening. If a punch assembly head 21*a*–*c* attempts to rotate, its curled projection 34*a*–*c* will engage base edge 11*e* to prevent such rotation. Curled projections 34*a*–*c* may be of other shapes but a curved curled shape is preferred. The retaining screws 26*a*–*c* are threadedly engaged in threaded housing openings 31*a*, 31*b* and 31*c* (FIG. 4). Punch pin P is shown in FIG. 4. Base bottom 11*c* is shown in FIG. 5. Slipper 23 has a center opening 29 to permit access to the retaining screws 26*a*–*c* without removing the slipper 23.

Figure 7:
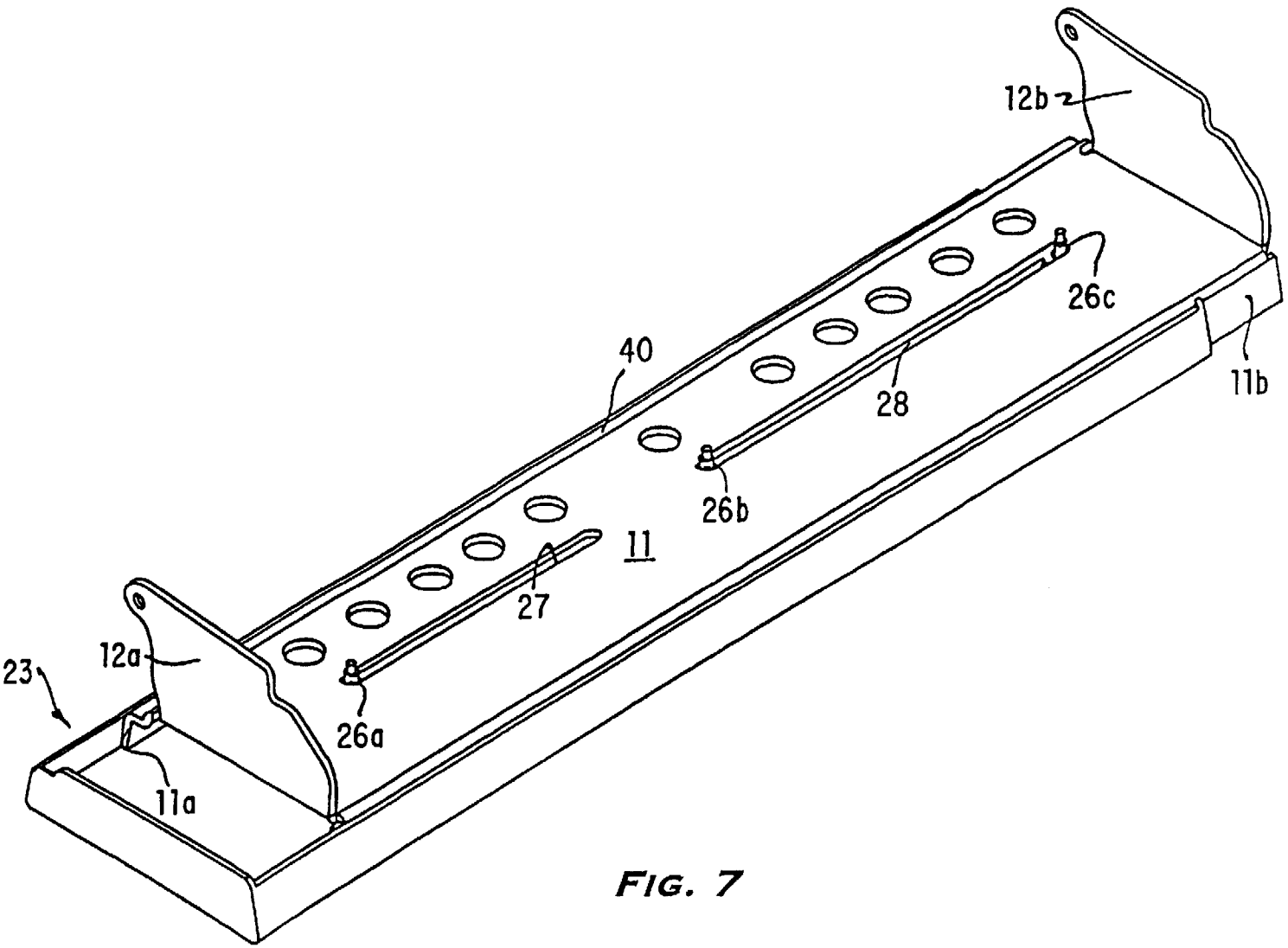
FIG. 7 is a top perspective view of the base with the slipper extended for emptying.

FIG. 7 shows the slipper 23 slid open for emptying and further shows the base rail 11*a*, 11*b*, end uprights 12*a*, 12*b*, slots 27, 28, retaining screws 26*a*–*c*, and groove 40.

Figure 8:
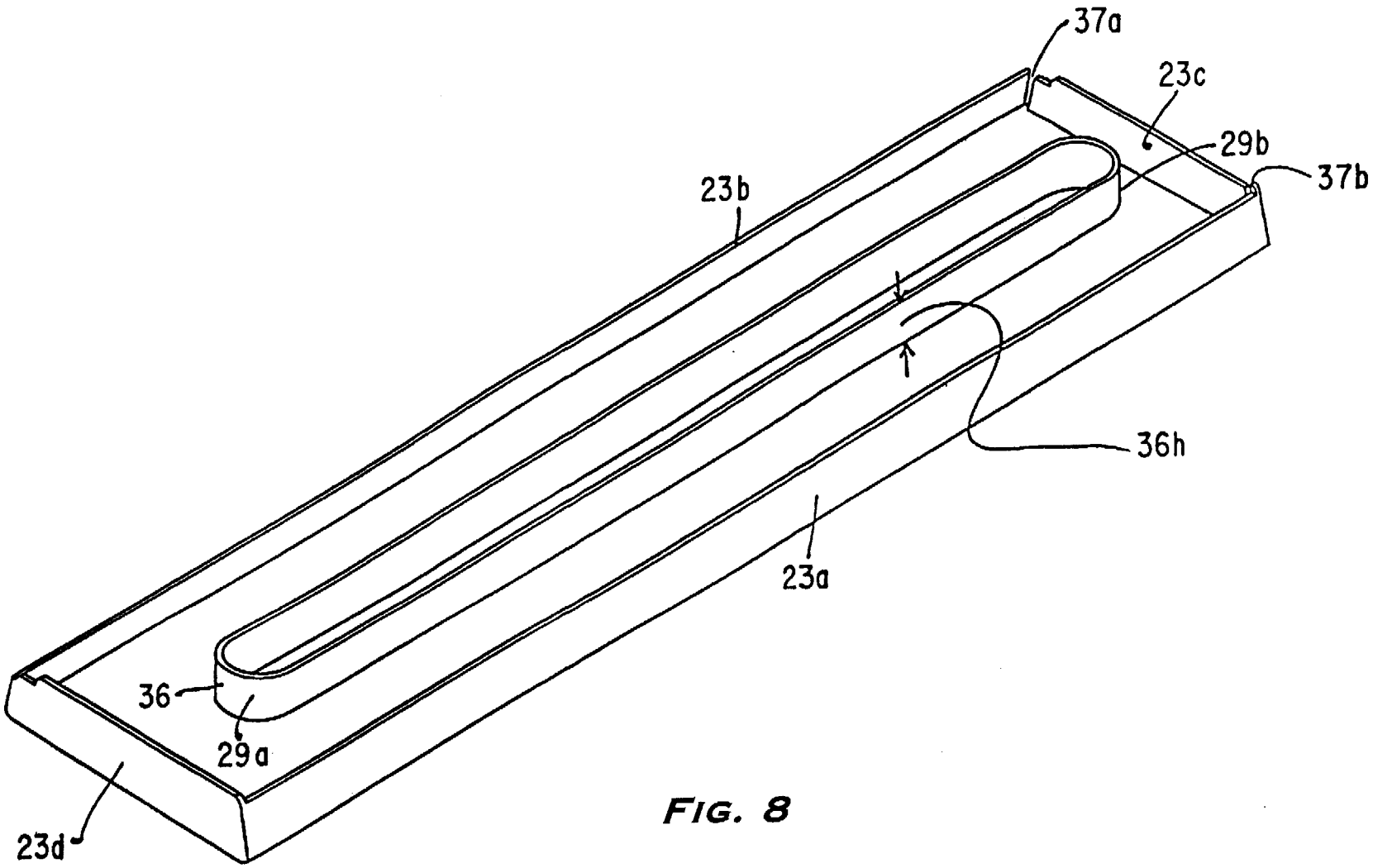
FIG. 8 is a top perspective view of the slipper.

In FIG. 8, the slipper's center opening 29 is bounded by cowling 36 having ends 29*a*, 29*b* which cowling 36 has a height 36*h* sufficient to nearly abut the base bottom 11*b* to prevent paper punch outs or chips from escaping and exiting through center opening 29. Also shown are slipper flanges 23*a*, 23*b* and slipper slotted end 23*c*, and slipper closed end 23*d*. Slots 37*a*, 37*b* permit the slipper 23 to be slid open without removal from the base rails 11*a*, 11*b*. When slipper 23 is slid open, end 29*a* of the cowling 36 engages retaining screw 26*c* to limit its travel. Center opening 29 is longer than the distance (D) between outside retaining screws 26*a* and 26*c* to permit sliding of the slipper 23 relative to the base 11. The length of the opening 29 is less than the overall length of the slipper 23 so that paper punch outs which are all deposited on one side of cowling 36 can migrate past ends 29*a*, 29*b* to the other side as punch 10 is handled and manipulated.

Figure 9:
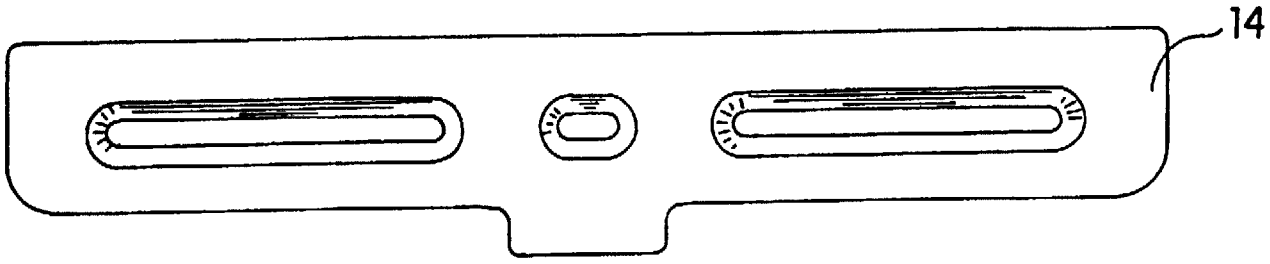
FIG. 9 is a plan view of the flap handle.
Figure 10:
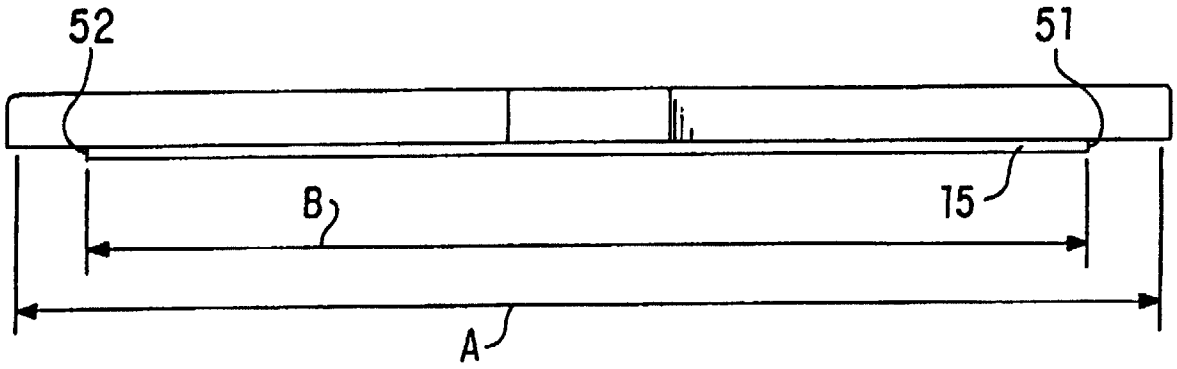
FIG. 10 is an elevational view of the handle viewed from the reverse curl edge.

Finally in FIGS. 9 and 10, the reverse curl portion 15 of handle 14 has a length B which is less than the overall length A of handle 14. Preferably, length B, as measured from a first end point 51 of the reverse curl portion to a second end point 52, is at least 60% of length A.

We claim:

1. A hand-operated punch comprising:

a) a handle having a generally upper planar surface;

b) a pivot pin for pivotally mounting said handle onto a base for pivoting movement about a longitudinal axis of said pivot pin;

c) said handle further having:

i) a remote flange portion disposed at substantially a 90° angle to said upper planar portion, said remote flange portion extending substantially parallel to said longitudinal axis on one side of and spaced from, said pivot pin;

ii) a near flange portion disposed at substantially a 90° angle to said upper planar portion, said near flange portion extending substantially parallel to of said longitudinal axis and from a first end of said punch to a second end of said punch on the side of said pivot pin opposite said one side and spaced from said pivot pin; and d) said near flange portion terminates at a location below said upper planar surface in a reverse curl portion defining an upright lip portion disposed under said upper planar surface.

2. The punch of claim in which:

a) the handle has a first length; and b) the reverse curl portion has a second length shorter than the first length and extends from a first point adjacent said first end of the punch to a second point adjacent said second end of said punch.

3. A hand-operated punch comprising:

a) a handle having a generally upper planar surface;

b) a pivot pin for pivotally mounting said handle on a base for pivoting movement about a longitudinal axis of said pivot pin;

c) said handle further having:

i) a remote flange portion disposed at substantially a 90° angle to said upper planar portion, said remote flange portion extending substantially parallel to said longitudinal axis on one side of and spaced from said pivot pin;

ii) a near flange portion disposed at substantially a 90° angle to said upper planar portion, said near flange portion extending substantially parallel to said longitudinal axis and from a first end of said punch to a second end of said punch on the side of said pivot pin opposite said one side and spaced from said pivot pin; and d) a punch engagement area disposed between the near and remote flange portions and spaced from said longitudinal axis for engagement with punch pins slideably mounted below said handle, upon pivoting of said handle about said longitudinal axis, to move said pins through material to be punched; and e) said near flange portion terminates at a location below said upper planar surface in a reverse curl portion defining an upright lip portion disposed under said upper planar surface.

4. The punch of claim 3 in which the handle has a first length and the reverse curl portion has a second length shorter than the first length and extends from a first point adjacent said first end of the punch to a second point adjacent said second end of said punch.

5. A hand-operated punch comprising:

a) a base;

b) a handle having a generally upper planar surface;

c) a pivot pin pivotally mounting said handle on said base for pivoting movement about a longitudinal axis of said pivot pin;

d) said handle further having:

i) a remote flange portion disposed at substantially a 90° angle to said upper planar portion, said remote flange portion extending substantially parallel to said longitudinal axis on one side of and spaced from said pivot pin;

ii) a near flange portion disposed at substantially a 90° angle to said upper planar portion, said near flange portion extending substantially parallel to said longitudinal axis and from a first end of said punch to a second end of said punch on the side of said pivot pin opposite said one side and spaced from said pivot pin; and e) punch pins slideably mounted below said handle, between the near and remote flange portion, said punch pins being spaced from said longitudinal axis for engagement by said handle, upon pivoting of said handle about said longitudinal axis, to move said pins through material to be punched; and f) said near flange portion terminates at a location below said upper planar surface in a reverse curl portion defining an upright lip portion disposed under said upper planar surface.

6. The punch of claim 5 in which the handle has a first length and the reverse curl portion has a second length shorter than the first length and extends from a first point adjacent said first end of the punch to a second point adjacent said second end of said punch.

* * * * *